United States Patent [19]

Kuze

[11] Patent Number: 5,076,083

[45] Date of Patent: Dec. 31, 1991

[54] DEVICE FOR PERFORMING PRESS WORK IN SEQUENCE

[76] Inventor: Yoshikazu Kuze, 31-3, Higashimagome 1-chome, Ohta-ku, Tokyo, Japan

[21] Appl. No.: 544,194

[22] Filed: Jun. 26, 1990

[30] Foreign Application Priority Data

Jun. 28, 1989 [JP] Japan ..... 1-164053

[51] Int. Cl.[5] ..... B21J 9/20; B21J 13/04; B21J 13/10

[52] U.S. Cl. ..... 72/12; 72/24; 72/405; 72/421; 72/422; 72/456; 10/12 T

[58] Field of Search ..... 72/21, 24, 405, 420, 72/421, 453.02, 456, 422, 12; 10/12 T

[56] References Cited

U.S. PATENT DOCUMENTS

| | | | |
|---|---|---|---|
| 2,942,503 | 6/1960 | Fitzgerald | 72/456 |
| 3,226,970 | 1/1966 | Phillipson et al. | 72/420 |
| 3,358,486 | 12/1967 | Beard | 72/24 |
| 3,435,650 | 4/1969 | Forster et al. | 72/24 |
| 3,504,512 | 4/1970 | Knowles | 72/421 |
| 3,525,248 | 8/1970 | Schulte et al. | 72/422 |
| 3,630,391 | 12/1971 | Wilson | 72/422 |
| 3,750,436 | 8/1973 | Harrison et al. | 72/421 |
| 4,449,390 | 5/1984 | Potini | 72/422 |
| 4,577,486 | 3/1986 | Baba | 72/422 |
| 4,604,021 | 8/1986 | Werner | 72/422 |

FOREIGN PATENT DOCUMENTS

| | | | |
|---|---|---|---|
| 304905 | 3/1989 | European Pat. Off. | 72/456 |
| 2746161 | 4/1979 | Fed. Rep. of Germany | 72/421 |
| 58283 | 5/1979 | Japan | 72/421 |
| 921245 | 5/1984 | Japan | 72/456 |
| 0126633 | 5/1988 | Japan | 72/421 |
| 0990502 | 1/1983 | U.S.S.R. | 72/24 |

*Primary Examiner*—David Jones

[57] ABSTRACT

Vertical guide posts are securely mounted on a base plate, and a cylinder plate is securely mounted on top portions of the guide posts. A hydraulic cylinder is mounted on the cylinder plate and a movable plate is slidably mounted on the guide posts. A piston rod of the hydraulic cylinder is connected to the movable plate. By vertically moving the movable plate, press work is performed.

10 Claims, 6 Drawing Sheets

DEVICE FOR PERFORMING PRESS WORK IN SEQUENCE

BACKGROUND OF THE INVENTION

The present invention relates to a press machine, and more particularly to a press machine based on a die set.

The die set comprises a die shoe as a base plate, guide pins vertically mounted on the die shoe, and a punch holder slidably mounted on the guide pins. A die is secured to the die shoe and a forming punch is secured to the holder. The holder is vertically moved by a press machine, thereby performing press work.

SUMMARY OF THE INVENTION

An object of the present invention is to provide a press machine which is very small in size and has a large power.

Another object of the present invention is to provide a press machine which is provided with pick-and-place devices for supplying a work and taking out a processed work, and is automatically operated by a sequence controller.

According to the present invention, there is provided a press machine comprising a base plate on which a die is to be mounted, vertical guide posts securely mounted on the base plate, a horizontal cylinder plate securely mounted on top portions of the guide posts, a hydraulic cylinder vertically mounted on the cylinder plate, a movable plate, on an underside of which a punch is to be secured, slidably mounted on the guide posts and connected to a piston rod downwardly extending from the hydraulic cylinder so as to be moved along the guide posts.

In an aspect of the invention, the press machine has a sequence controller attached to the cylinder plate for automatically operating the press machine and a pair of pick-and-place devices for supplying a work to the press machine and taking out a finished work.

The pick-and-place device comprises a holding plate provided to be vertically moved by hydraulic cylinders, a slide slidably mounted on the holding plate so as to be moved toward a die in the press machine, and grips mounted on the slide and arranged so as to grip a work.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become more apparent from the following detailed description with reference to the accompanying drawings which are given by way of illustration only, and thus are not limitative of the present invention, and wherein.

DETAILED DESCRIPTION OF THE PREFERRED EMBODIMENT

Figure 1:
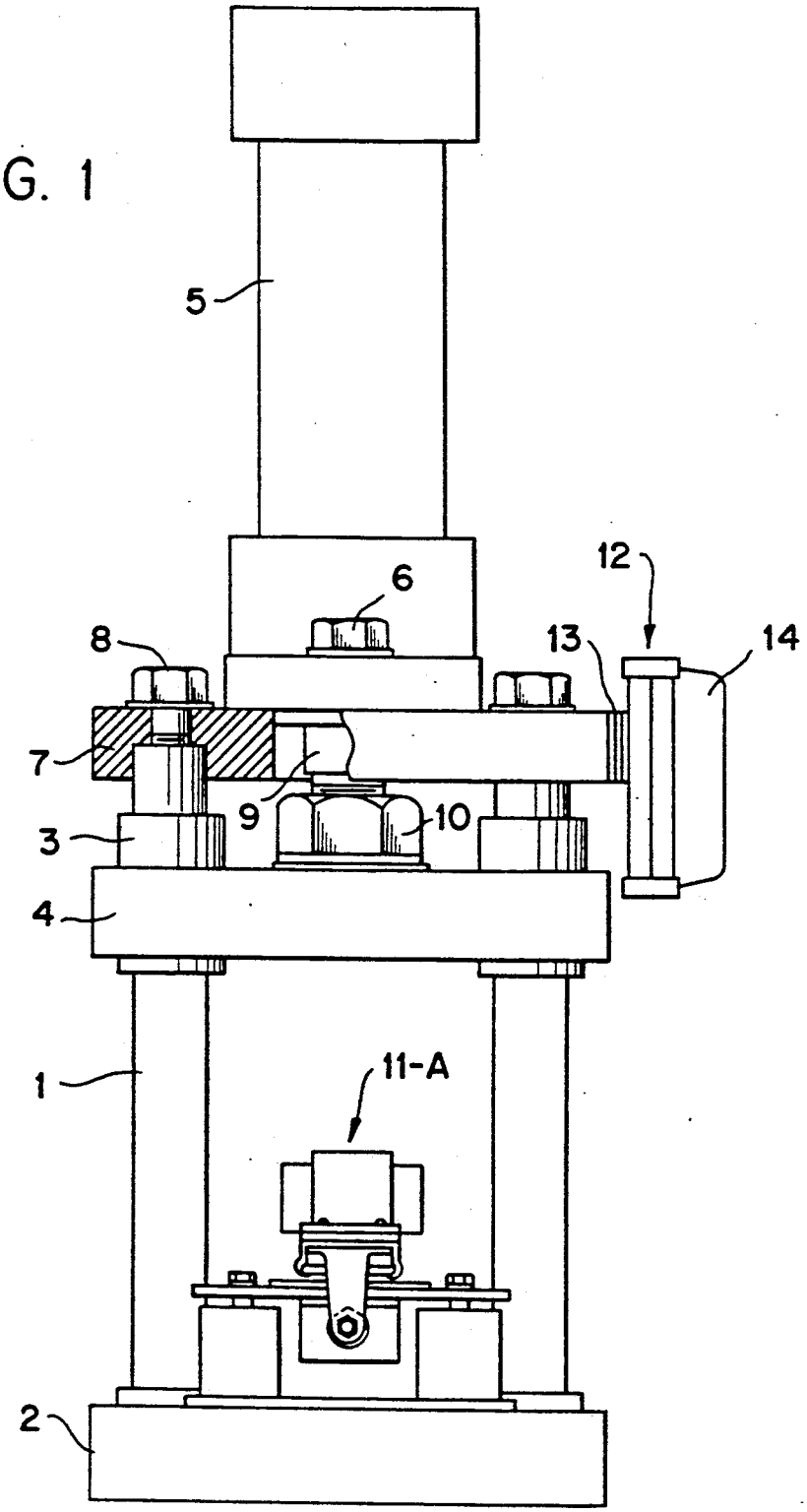
FIG. 1 is a front elevational view of a press machine according to the present invention.
Figure 2:
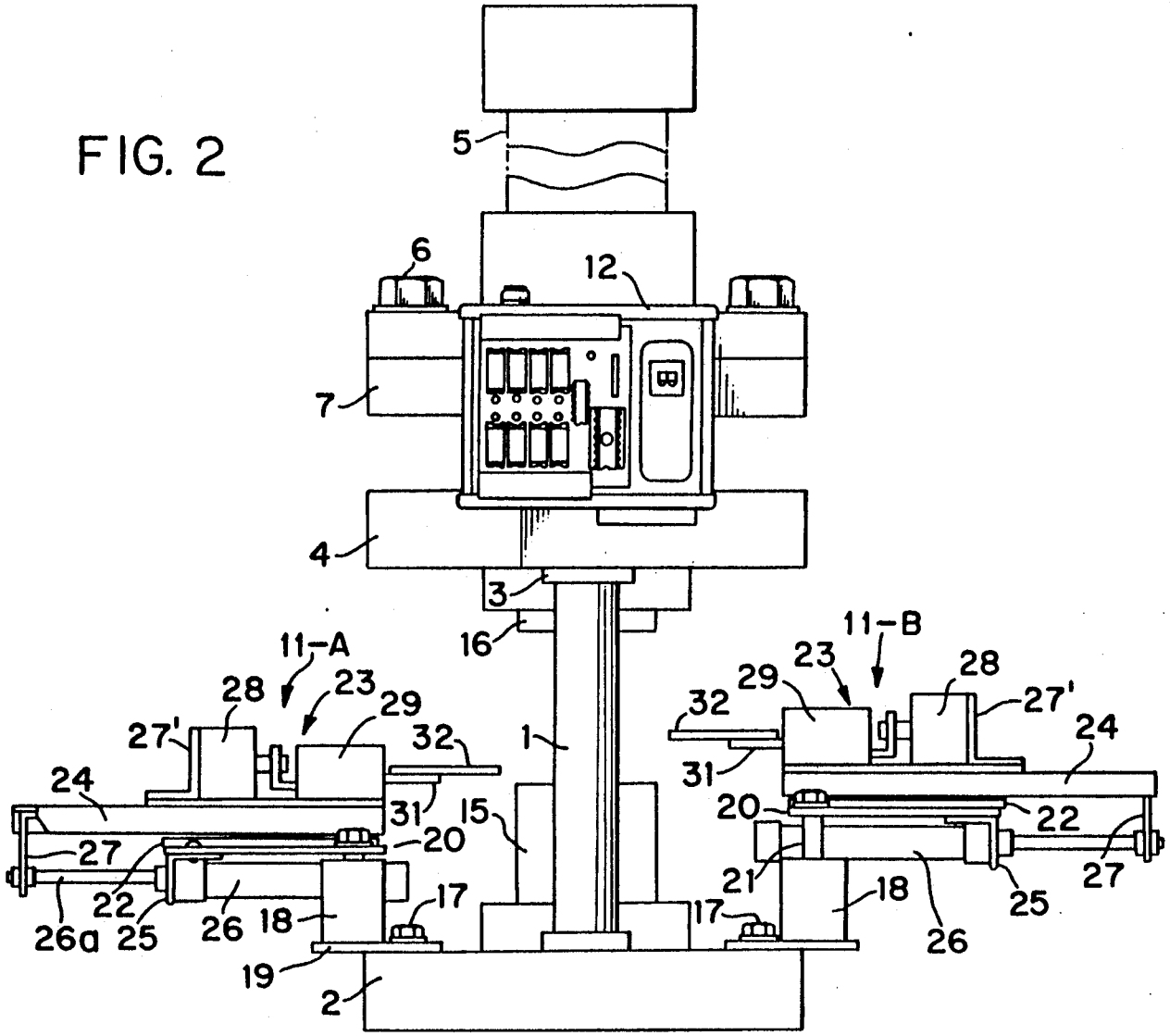
FIG. 2 is a side view of the press machine.

Referring to FIGS. 1 and 2, two vertical guide posts 1 are securely mounted on a base plate 2. A movable plate 4 is slidably mounted on the guide posts 1 by slidably engaging a guide bush 3 with each guide post 1. A horizontal cylinder plate 7 is secured to the guide posts 1 at the top of each post and secured thereto by a screw 8. A hydraulic cylinder 5 such as an oil hydraulic cylinder is vertically mounted on the cylinder plate 7 and secured thereto by screws 6. A piston rod 9 of the cylinder 5 is downwardly extended passing a hole formed in the cylinder plate 7 and has a screw thread. The piston rod 9 is secured to the movable plate 4 by engaging the screw thread in the movable plate and locked by a lock nut 10. On the base plate 2, a die 15 is mounted and a punch 16 is secured to the underside of the movable plate 4. Thus, by operating the cylinder 5, press work can be performed on the die 15. A sequence controller 12 which is covered by a cover 14 is attached to the cylinder plate 7 through a connector 13 in order to automatically operate the press machine.

Mounted on the base plate 2 are a pick-and-place device 11-A for supplying a work on the die 15 and a pick-and-place device 11-B for taking out a processed work. Since both the devices 11-A and 11-B are the same in structure, the device 11-A is described hereinafter.

Figure 3:
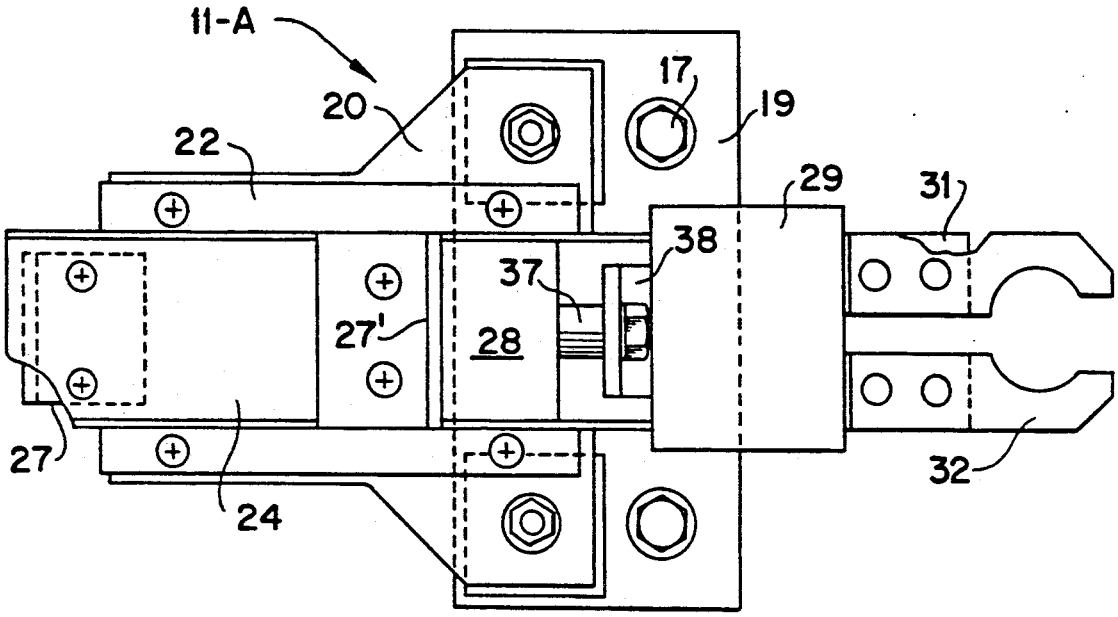
FIG. 3 is a plan view of a pick-and-place device.
Figure 4:
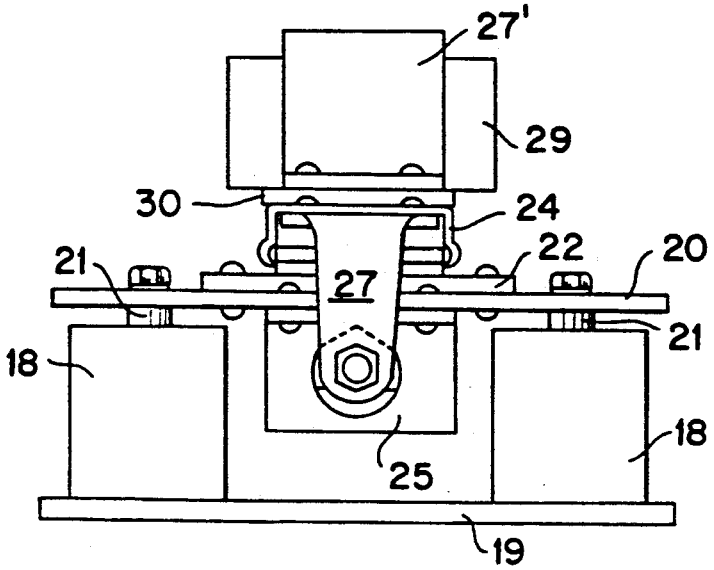
FIG. 4 is a side view of the pick-and-place device.

Referring to FIGS. 2 to 4, a pair of vertical cylinders 18 are secured on a supporting plate 19 which is securely mounted on the base plate 2 by screws 17. A holding plate 20 is secured to piston rods 21 of the cylinders 18. Secured to the holding plate 20 is slide guide 22 having a ball guide plain on which a slide 24 is slidably mounted. On the underside of the holding plate 20, a horizontal cylinder 26 is secured through angles 25 and a piston rod 26*a* thereof is connected to the slide 24 through a connecting plate 27. Thus, the slide 24 may be moved to the die 15.

On the slide 24, a work gripping device 23 is mounted. The work gripping device 23 comprises a cylinder 28 secured to the slide 24 through an angle 27' and a direction changing device 29 for changing the direction of the reciprocating motion of a piston rod 37 of the cylinder 28.

Figure 6:
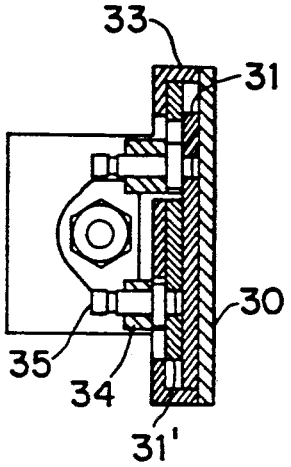
FIG. 6 is a sectional view taken along a line VI—VI of FIG. 5.
Figure 5:
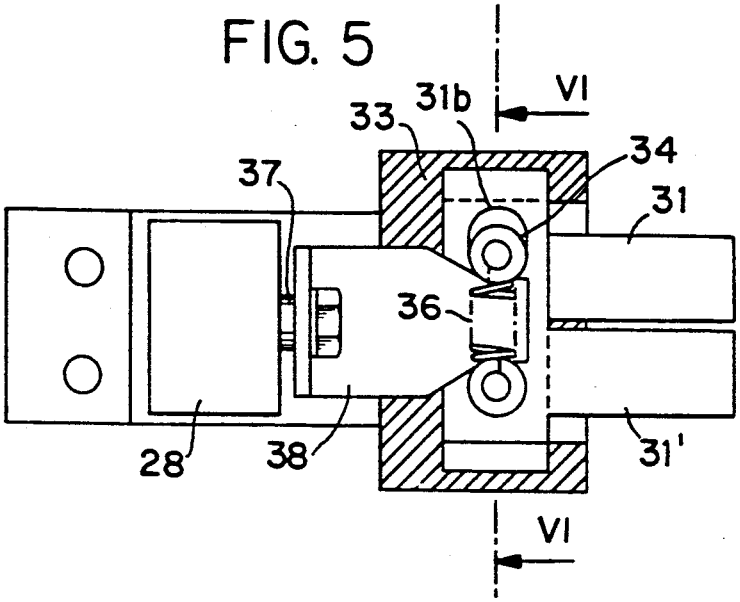
FIG. 5 is a sectional plan view of a work gripping device.
Figure 7A:
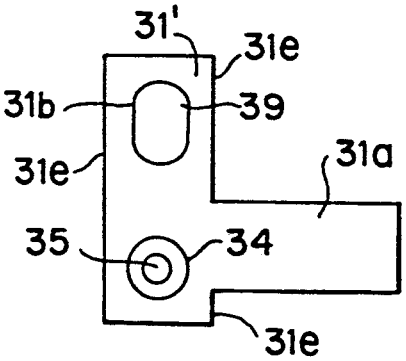
FIGS. 7*a* and 7*b* are plan views of grip holders.
Figure 7B:
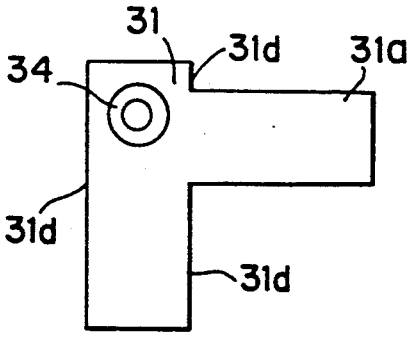
Figure 7C:
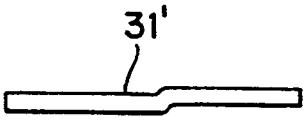
FIGS. 7*c* and 7*d* are side views of the grip holders.
Figure 7D:
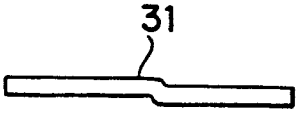

Referring to FIGS. 5 and 6, the direction changing device 29 comprises a cam plate 38 secured to the piston rod 37 and slidably mounted in a case 33, and a pair of grip holders 31 and 31'. Each of the grip holders 31 and 31' has an L-shape in plan view which is symmetrical with the L-shaped of the other holder. A base portion of the grip holder 31' is superimposed on a base portion of the grip holder 31. As shown in FIGS. 7*c* and 7*d*, the holders 31 and 31' are bent so that both holding portions 31*a* may be flushed with each other. Each grip holder 31 (31') has a roller 34 rotatably mounted on a pin 35 secured thereto. Both holders are laterally slidably mounted in the case 33. Sides 31*d* of the holder 31 and sides 31*e* of the holder 31' are guided by inner walls of the case 33. The roller 34 of the holder 31 is upwardly projected passing through a hole 31*b* formed in the holder 31'. Between the pins 35, a spring 36 is provided so as to engage both rollers 34 with the cam plate 38. A grip 32 is secured to each holder. The cam plate has opposite inclined sides engaged with the rollers 34.

Thus, the grips 32 are moved in the vertical direction by the operation of the cylinders 18 and in the longitudinal direction by the cylinder 26. Further, the grips 32 are moved in the opposite lateral directions by the reciprocating movement of the cam plate 38 caused by the cylinder 28. Consequently, the grips 32 of the pick and-place devices 11-A and 11-B operate to supply a work to the die 15 and to take out the finished work from the die. Since the length of the sides 31*d* and 31*e* is long, the sliding operation of the grips is stable so that the work is reliably gripped by the grips 32.

Figure 8:
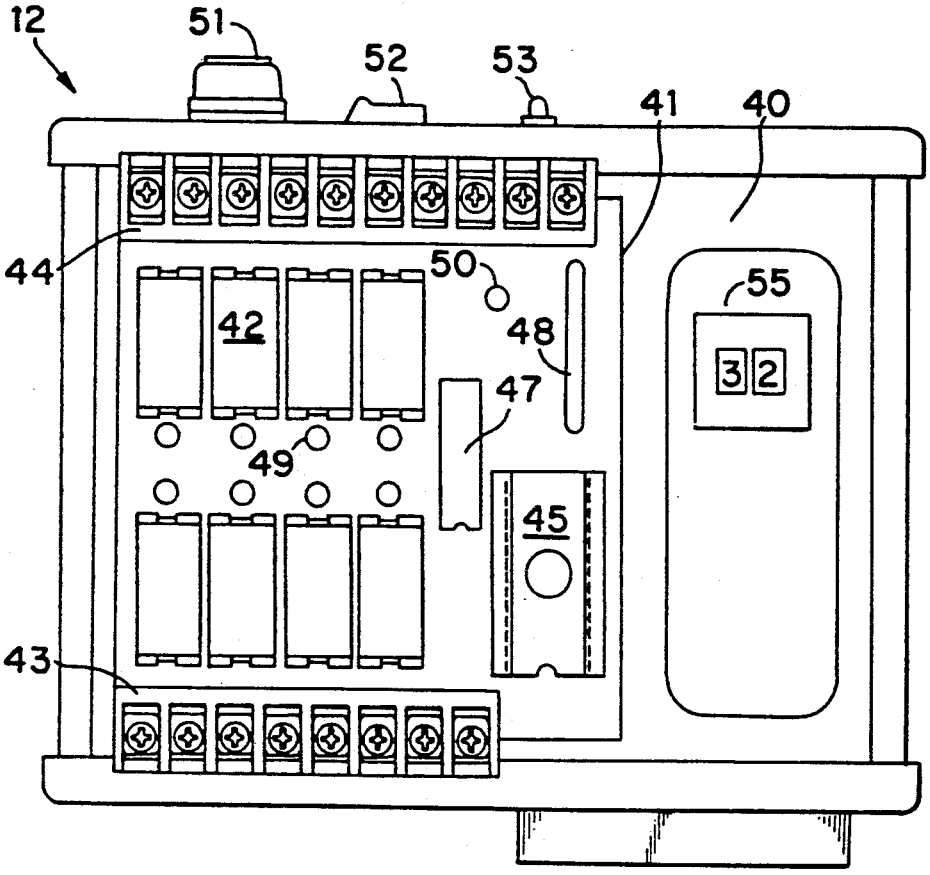
FIG. 8 is a front view of a sequence controller.
Figure 9:
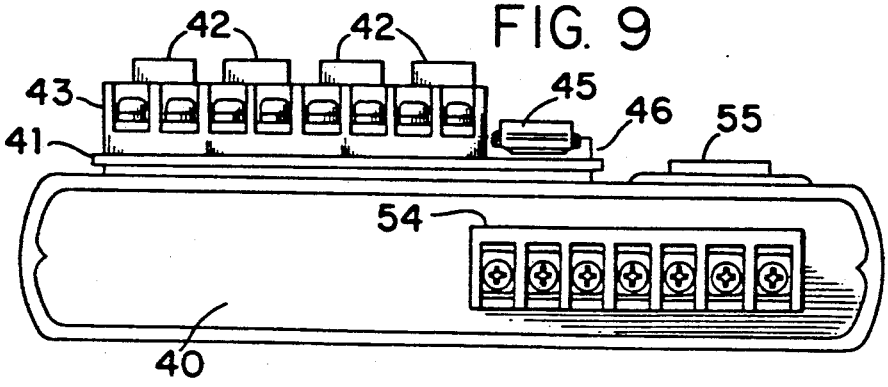
FIG. 9 is a side view of the sequence controller.

Referring to FIGS. 8 and 9, the sequence controller 12 comprises a read clock pulse control unit 40 having a supply source and an output relay unit 41 mounted on the clock pulse control unit 40.

The output relay unit 41 comprises a board detachably secured to the control unit 40. A number of relays 42, such as eight relays are mounted on the board. Terminal units 43 and 44 are disposed adjacent to the relay unit 41. The terminal unit 43 has eight terminals for four relays and the terminal unit 44 has ten terminals for the other four relays and for an alternating current power supply. An EPROM 45 is detachably fixed to a connector 46. Numeral 47 is a transistor array, and 48 is a connector for the clock pulse control unit 40 and the output relay unit 41. A display 49 employed with an LED is provided by displaying the operation of each relay. An abnormality display 50 with an LED is provided.

On the read clock pulse control unit 40, a fuse 51, a power switch 52, a reset switch 53 and input terminals 54 are provided. A preset code switch 55 displays digits of two figures for one cycle time and is adapted to select a necessary cycle time. If the unit time for the digits is 0.1 second, digits "32" of preset code switch 55 shown in FIG. 8 signify a cycle time of 3.2 seconds being set. The cycle time of the preset code switch can be set to a time between 0.1 and 9.9 seconds.

Figure 10:
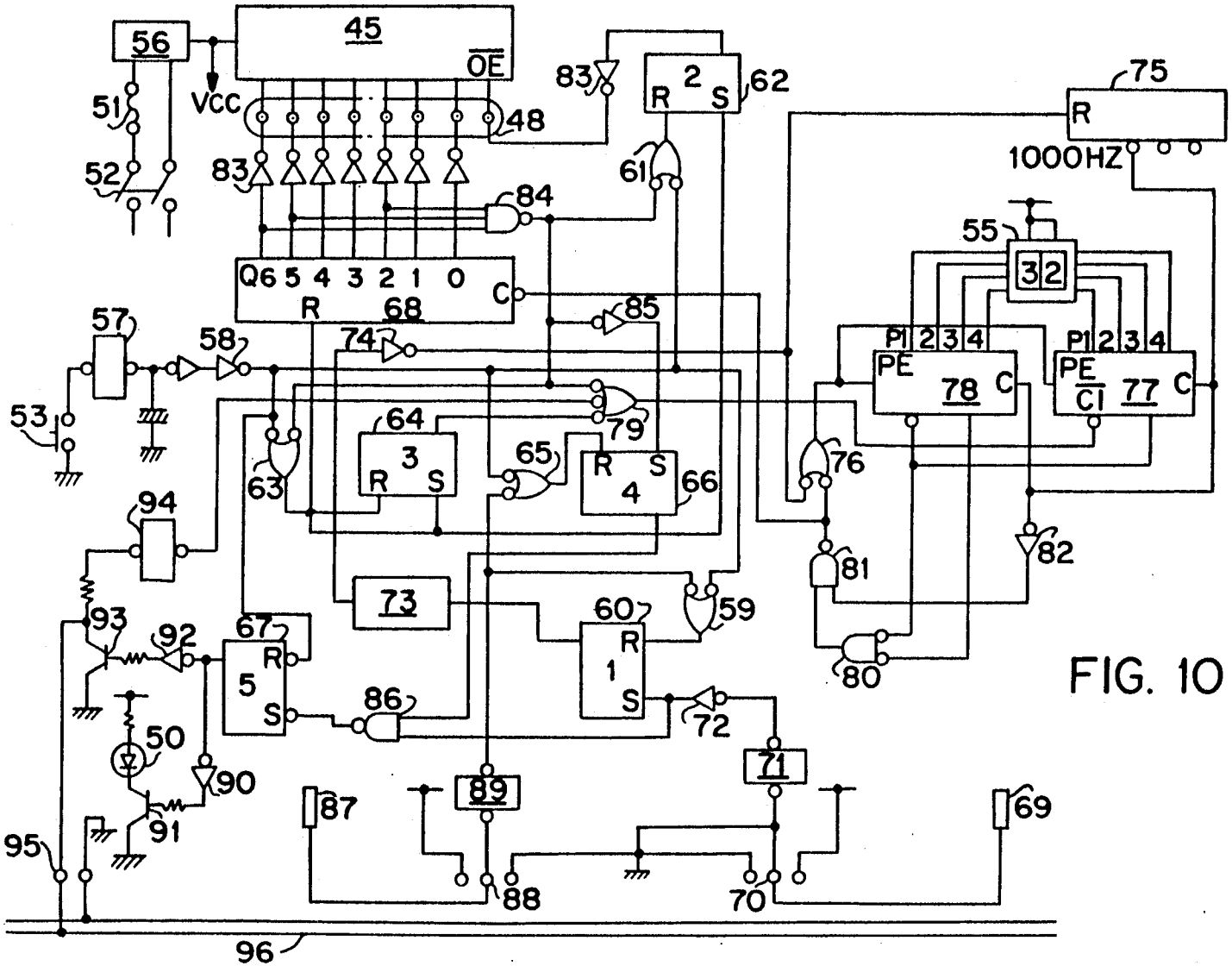
FIG. 10 shows a circuit of the sequence controller.

Referring to FIG. 10 a circuit of the sequence controller 12, is shown with the cycle time being set to 3.2 seconds by the preset code switch 55. When power switch 52 and reset switch 53 are depressed, the supply voltage Vcc is obtained by a switching regulator 56, and a system supply voltage is applied to an initial reset circuit 57 to reset each of a number of flip-flops. When the supply voltage is applied, a first flip-flop 60 is reset through a 2-input NAND gate 59, a second flip-flop 62 is reset through a 2-input NAND gate 61, a third flip-flop 64 is reset through a 2-input NAND gate 63, and a fourth flip-flop 66 is reset through a 2-input NAND gate 65. A fifth flip-flop 67 is reset through an inverter 58. A binary counter 68 is reset through the 2-input NAND gate 63.

When a work product passes a feed sensor 69 which is provided near an inlet of the press machine, a signal having a 0 level is produced to set the first flip-flop 60 through a first input terminal 70, a chatter preventing circuit 71, and an inverter 72. A one-shot pulse "1" appears at the output of a one-shot pulse generating circuit 73. This one-shot pulse "1" is applied:

A. to a reset input R of a clock pulse generating circuit 75 to reset it to the zero state, and to inputs PE of presettable down counter 77 and 78 through an inverter 74 and a 2-input NAND gate 76 to preset the digit "32" of preset code switch 55 in counters 77 and 78, respectively; and B. to a set terminal S of the second flip-flop 62, the output thereof being applied to the terminal $\overline{OE}$ of the EPROM 45 through one of transistor arrays 83 and the EPROM in turn is set to an output state, and to a set terminal S of the third flip-flop 64 to produce an output 0 which is applied to the terminal $\overline{CI}$ of the presettable down counter 77 through a 3-input NAND gate 79 to produce clock pulses.

The output of the clock pulse generating circuit 75, provided with a crystal oscillator, is 1000 Hz, as clock pulses. The clock pulses are applied to clock lines C of the presettable down counters 77 and 78, respectively. Preset lines P1, P2, P3 and P4 of the presettable down counters are connected to BCD lines of preset code switch 55.

Each time one clock pulse is applied to the presettable counter 77, the preset count therein decreases by one. When 32 clock pulses are applied to the presettable counters, both inputs of a 2-input NOR gate 80 go to a "0". Thus, the 2-input NOR gate 80 produces one read clock pulse.

On the other hand, when the output of the 2-input NOR gate 80 goes to "1", a 2-input NAND gate 81 outputs a "0" when an inverter 82 produces output "1" by a negative going clock input. Thus, terminal PE of each presettable counter are applied, with a pulse "1" through the 2-input NAND gate 76. At this time, the "32" of the preset code switch 55 is preset again in the presettable down counters.

Thus, every time 32 clock pulses are applied to the presettable counters, one read clock pulse is generated from the gate 80. The read clock pulse is applied to the clock line C of the binary counter 68. Accordingly, the binary counter 68 produces outputs through address lines Q0 to Q6, so that the outputs are applied to the address in the EPROM 45 through transistor arrays 83 and connector 48.

Time of one cycle is decided by the number of read clock pulses. Operation in the case of 100 read clock pulses in one cycle will be explained hereinafter.

In order to produce the one-cycle end signal upon 100 read clock pulses, address lines Q2, Q5 and Q6 of the binary counter 68 are selected as the inputs of a 3-input NAND gate 84. Since the binary number of "100" is 1100100, when the 100th read clock pulse is applied to the input of the binary counter 68, outputs on the address lines Q2, Q5 and Q6 go to "1" and the 3-input NAND gate 84 produces a one-cycle end signal "0".

When one cycle is completed, the second flip-flop 62 is reset through the 2-input NAND gate 61, so that the EPROM 45 stops producing an output. The third flip-flop 64 is reset through 2-input NAND gate 63. The presettable down counter 77 stops producing an output through the 3-input NAND gate 79. Thus, each of the actuators of the machine stops. The fourth flip-flop 66 is set through an inverter 85. A first input of a 2-input NAND gate 86 as an abnormality signal output gate is changed to "1".

When the work product after the manufacturing process passes a discharge sensor 87 provided on an outlet of the machine, a signal having a 0 lever is applied to a second input terminal 88. The first flip-flop 60 is reset through a chatter preventing circuit 89 and 2-input NAND gate 59. Further, the fourth flip-flop 66 is reset by the output of the 2-input NAND gate 65 to change the first input signal of the abnormality signal output gate of 2-input NAND gate 86 into a "0". Then, the first flip-flop 60 is set when the feed sensor 69 produces a signal, thereby restarting the operations of the control system and actuators of the machine. The operations of the actuators are continued unless an abnormality occurs.

When the work does not pass on the discharge sensor 87 at the end of the one cycle operation, a signal from the discharge sensor 87 is not applied to the first flip-flop 60 so that the first flip-flop 60 is not reset. Both of the inputs of the 2-input NAND gate 86 becomes "1" when a signal is applied from the feed sensor 69 so that the fifth flip-flop 67 is set. A transistor 91 is turned on through the output of an inverter 90 to activate the abnormality display 50. Further, a transistor 93 is turned on through the output of an inverter 92. The output 0 of the transistor 93 is applied to the 3-input NAND gate 79 through a chatter preventing circuit 94. A signal at the "1" level of the NAND gate 79 is applied to $\overline{CI}$ of counter 77 to stop the operation of the counter 77, thereby stopping the operations of the actuators of the press machine.

The 0 output is further applied to other counters 77 of the other sequence controller through an input/output terminal 95 and an external control line 96, thereby stopping corresponding parts.

If an abnormality occurs in the sequence controller, the abnormality display 50 emits a light signal and inspection and repair of the sequence controller are done. Thereafter, the reset switch 53 is depressed so that the sequence controller restarts operation. The sequence controller has eight relays. In order to increase the output of the controller, the number of the sequence controllers is increased.

A known parts-feeder is provided for automatically lining up work parts at predetermined positions in synchronism with the cycle time of the press machine and this operation is repeated. Predetermined numbers of work parts are lined up to pass by the feed sensor 69. The parts-feeder is controlled in accordance with the sequence controller. The sequence controllers are connected to each other with the control line 96 through the input/output terminals 95. If an abnormality occurs in one of the sequence controllers, all of the sequence controllers are stopped through the control line 96. Inspection and repair of the abnormal sequence controller are done. Thereafter, the reset switch of the repaired sequence controller is depressed so that the controllers restart operation at the same time.

While the invention has been described in conjunction with preferred specific embodiment thereof, it will be understood that this description is intended to illustrate and not limit the scope of the invention, which is defined by the following claims.

What is claimed is:

1. A press machine comprising:

a base plate on which a die is to be mounted;

generally vertical guide posts securely mounted on said base plate;

a generally horizontal cylinder plate having a hole defined therein, said generally horizontal cylinder plate being securely mounted on top portions of said guide posts;

a hydraulic cylinder generally vertically mounted on said cylinder plate, said hydraulic cylinder having a piston rod;

a movable plate, on an underside of which a punch is to be secured, slidably mounted on said guide posts and connected to the piston rod extending downwardly from said hydraulic cylinder through the hole in the cylinder plate, said movable plate being movable along the guide posts; and a sequence controller attached to said cylinder plate for automatically operating the press machine, said sequence controller having a memory, a control unit including a clock pulse generating circuit for producing clock pulses, a presettable counter for counting the clock pulses, and for producing a read clock pulse after every preset count has been reached, a binary counter for counting the read clock pulse and for producing outputs for addressing said memory, so that the memory produces data outputs to turn on relays for operating the press machine, and a control circuit for controlling start and stop operations of the counters, said sequence controller further having a first sensor detecting a feed of the work product into the press machine and for producing a feed signal, a first flip-flop responsive to said feed signal for operating said clock pulse generating circuit, presettable counter, and binary counter, first gate means responsive to a count end signal of said binary counter for producing a stop signal of said binary counter for producing a stop signal for stopping the production of said read clock pulse from the presettable counter, second gate means opened by the count end signal, a second sensor detecting a discharge of the fed work product and for producing a discharge signal to close said second gate means, first circuit means responsive to an absence of said discharge signal for keeping the second gate means open to produce an abnormality signal, and second circuit means responsive to the abnormality signal for stopping operation of the presettable counter.

2. The press machine according to claim 1, wherein a bottom of the hydraulic cylinder is mounted to a top of the cylinder plate and wherein the guide posts fail to extend above said hydraulic cylinder.

3. The press machine according to claim 1, further comprising a first pick-and-place device provided at a side of said base plate for supplying a work product to the press machine; and a second pick-and-place device provided at another side opposite to said first pick-and-place device for taking out a finished work product.

4. The press machine according to claim 3, wherein at least one of said pick-and-place devices comprises a holding plate vertically movable by hydraulic cylinders, a slide slidably mounted on said holding plate so as to be moved toward the die in the press machine, and grips mounted on said slide and arranged to grip the work product.

5. The press machine according to claim 3, wherein the first pick-and-place device moves in a generally linear horizontal direction to place the work product in the die on the base plate and the second pick-and-place device moves in the same generally linear horizontal direction to remove the work product from the die such that the work product moves generally straight through the press machine.

6. The press machine according to claim 5, further comprising a work gripping device and generally horizontal cylinders for each of the first and second pick-and-place devices, the generally horizontal cylinders moving the work product in the work gripping device toward and away from the die.

7. The press machine according to claim 6, further comprising a slide operatively connected between the work gripping device and the generally horizontal cylinder of each of the first and second pick-and-place devices, each of the slides having a gripper cylinder mounted thereon with grip holders connected to the gripper cylinders, the gripper cylinders move the grip holders in lateral directions to grip and release the work product.

8. The press machine according to claim 7, further comprising a direction changing device mounted between the gripper cylinder and the grip holders of each of the first and second pick-and-place devices, each of the direction changing devices comprising a cam connected to a piston rod of the gripper cylinders a case, and a pair of the movable grip holders, each of the grip holders having an L-shape which is generally symmetrical to the L-shape of the other grip holder of the pair, grips being attached to the grip holders, and one end of the cam and one end of the grip holders being positioned in the case.

9. The press machine according to claim 8, wherein each of the grip holders has a roller attached thereto, the rollers of each pair of grip holders being connected by a spring which biases the grips on the grip holders toward one another, the end of the cam in the case being positioned between the rollers such that movement of the cam by the gripper cylinder cases said rollers to move away from one another resulting in the grip holders with the grips moving away from one another.

10. The press machine according to claim 6, further comprising a generally vertical cylinder for each of the first and second pick-and-place devices for moving the work gripping devices in a generally vertical direction whereby the work product is movable by the pick-and-place devices in vertical and horizontal directions.

* * * * *